US005277276A

United States Patent [19]

Pramanik et al.

[11] Patent Number: 5,277,276

[45] Date of Patent: Jan. 11, 1994

[54] COMPENSATING ROPE SHEAVE TIE DOWN

[75] Inventors: Mukunda B. Pramanik, Burlington; John K. Salmon, South Windsor, both of Conn.

[73] Assignee: Otis Elevator Company, Farmington, Conn.

[21] Appl. No.: 957,497

[22] Filed: Oct. 7, 1992

[51] Int. Cl.[5] ..... B66B 11/04

[52] U.S. Cl. ..... 187/22; 187/94

[58] Field of Search ..... 187/1A, 20, 22, 26, 38, 82, 83, 89, 90, 91, 94, 105, 107

[56] References Cited

U.S. PATENT DOCUMENTS 1,789,008 1/1931 Lindquist ..... 187/94
1,953,119 4/1934 McCormick ..... 187/22
1,976,494 10/1934 Halfvarson ..... 187/22
3,653,467 4/1972 Showalter ..... 187/22

*Primary Examiner*—Robert P. Olszewski
*Assistant Examiner*—Kenneth Noland

[57] ABSTRACT

A compensating rope sheave tie down assembly prevents the compensating rope sheave from sudden upward movement if the elevator car suddenly jumps upward. The compensating rope sheave assembly comprises a strap, an inertia reel that permits the strap to follow slow movement of the compensating rope sheave, and a spring retaining mechanism that maintains the strap taut at all times. By restricting the upward movement of the sheave, the sheave tie down prevents further upward movement of the elevator car as well.

9 Claims, 3 Drawing Sheets

COMPENSATING ROPE SHEAVE TIE DOWN

BACKGROUND OF THE INVENTION

1. Technical Field

This invention relates to an elevator system and, more particularly, to a compensating rope sheave tie down.

2. Background Art

A conventional elevator system comprises an elevator car suspended on one end of a hoist rope in a hoistway with a counterweight suspended on the other end of the hoist rope. A compensating rope is hung from the underside of the elevator car to the underside of the counterweight to balance the weight of the hoist rope as the car and counterweight move alternatingly up and down within the hoistway. A compensating rope sheave disposed on the bottom of the hoistway allows the compensating rope to pass therethrough. The sheave travels a relatively short distance vertically along a set of guide rails to accommodate for expansion and contraction of the ropes resulting from changing weather conditions.

Typical elevator systems also include a tie down of the compensating rope sheave, wherein the tie down serves two functions. One function is to allow the sheave to move slowly within the limits of the guide rails to accommodate for the weather changes. The other function of the tie down is to prevent the sheave from sudden upward movement if the elevator car suddenly jumps upward. Thus, if the elevator car suddenly moves upward, subsequently pulling the compensating rope sheave upward, the tie down would hold the compensating sheave down. As a result, the tie down would stop the elevator car from further upward movement, since the compensating rope will be retained by the sheave and will not be able to travel upward.

Typical kinds of tie downs currently employed in the industry are either a ratchet and pawl type system or a hydraulic system. The conventional ratchet and pawl type system may jam and stop the vertical motion of the compensating sheave. The hydraulic system is very complex and expensive.

DISCLOSURE OF THE INVENTION

It is an object of the present invention to provide a safe elevator system.

It is a further object of the present invention to prevent the compensating rope sheave from moving upward suddenly.

According to the present invention, a compensating rope sheave tie down assembly prevents a sudden accelerated motion of a compensating rope sheave in an elevator system, thereby preventing further sudden upward acceleration of an elevator car. The tie down allows the compensating rope sheave to travel slowly up and down on a set of guide rails within a hoistway during the normal operating of an elevator car. However, if the elevator car experiences a sudden upward movement, thus pulling the compensating rope and compensating rope sheave suddenly upward, the tie down will lock up. Thus, the tie down prevents the compensating rope sheave from moving upward thereby preventing the elevator car from moving upward as well.

These and other objects, features and advantages of the present invention will become more apparent in light of the following detailed description of a best mode embodiment thereof as illustrated in the accompanying drawings.

BEST MODE FOR CARRYING OUT THE INVENTION

Figure 1:
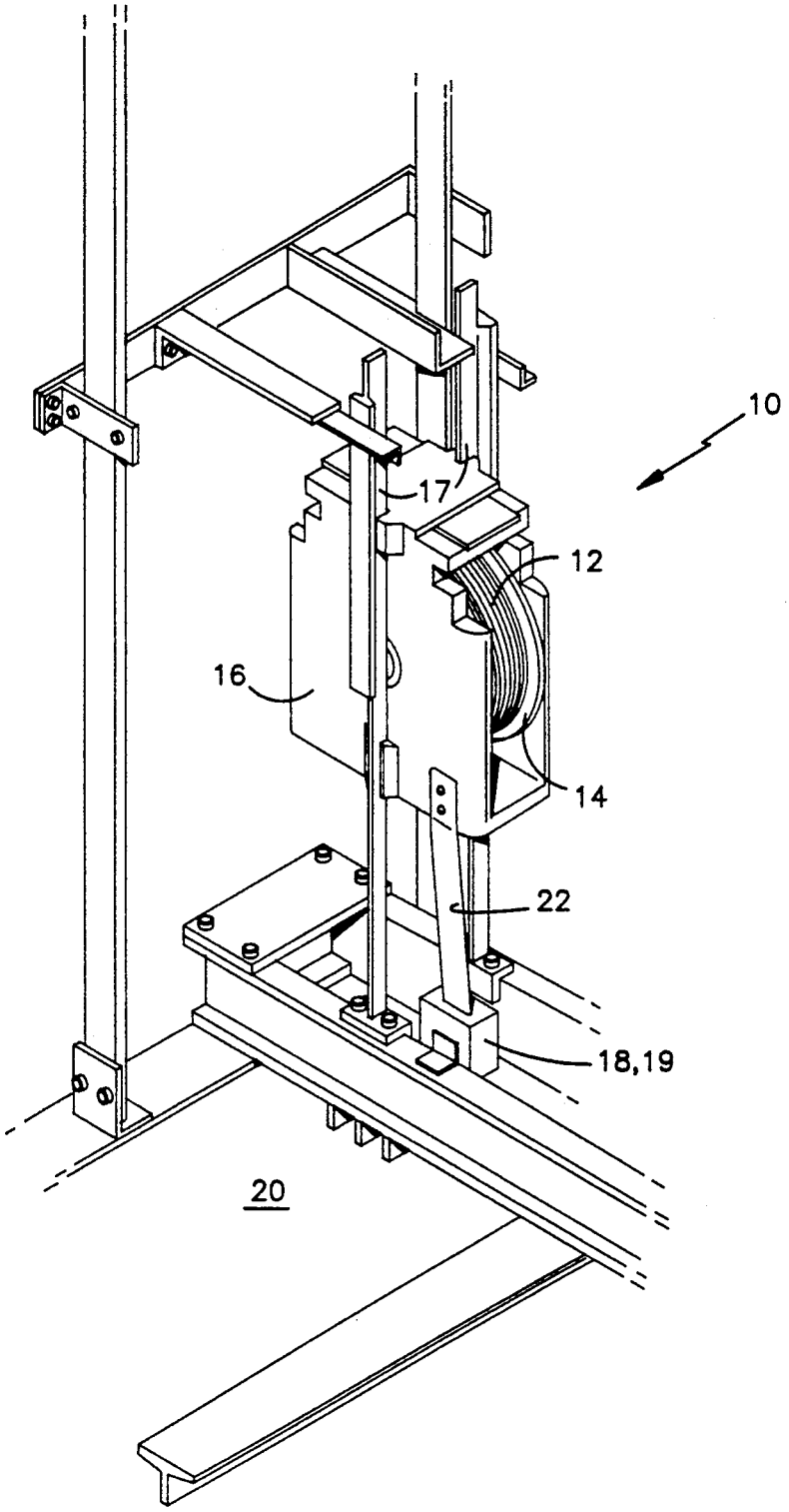
FIG. 1 is a top perspective view of a compensating rope sheave and tie down assembly according to the present invention.

FIG. 1 depicts a compensating rope sheave tie down system 10 disposed on a bottom of a hoistway (not shown) in an elevator system (not shown). The compensating rope sheave tie down system 10 comprises a compensating rope 12 dispensed from the compensating rope sheave 14 enclosed within a sheave housing 16, as known in the art. The sheave housing 16 is guided by a set of guide rails 17, as is also known in the art. The system 10 further includes a conventional inertia reel 18 with a spring retraction mechanism 19, both fixedly attached to a pit floor 20 of the hoistway. A strap 22 extends from the inertia reel and spring retraction mechanisms 18,19 and is fixedly attached to the compensating rope sheave housing 16.

In operation, an elevator car (not shown) is suspended on one end of a hoist rope (not shown) and a counterweight (not shown) is suspended on the other end of the hoist rope. The compensating rope 12 is hung from the underside of the elevator car on one end and from the underside of the counterweight on the other end to provide a balancing effect for the hoist rope.

Under normal operating conditions, the compensating rope sheave housing 16 travels up and down the guide rails 17 to accommodate for contraction and expansion in the compensating rope 12 resulting from a change in weather or other conditions. The slightly taut strap 22 follows the sheave housing 16 at all times. The spring retraction mechanism 19 maintains the strap 22 tautness. The inertia reel 18, as is well known in the art, allows the strap 22 to extend or retract, as long as the rate of extension of the strap 22 does not exceed a preset therein limit. However, if the elevator car suddenly moves upward, the inertia reel 18 will experience a sudden change of velocity and will lock the strap movement when the rate of extension of the strap exceeds the preset limit. The strap then stops any further upward movement of the compensating rope sheave and subsequently any further movement of the elevator car. The system will revert back to the normal mode when the suddenly applied force is removed from the system.

Figure 2:
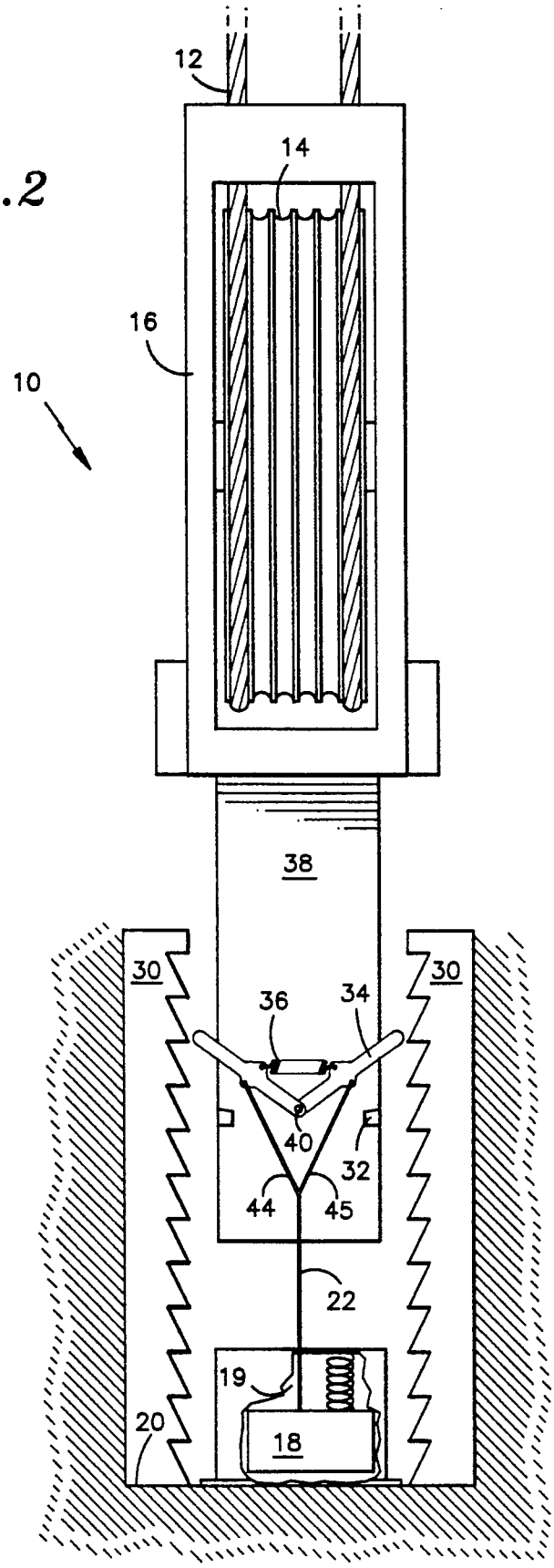
FIG. 2 is a diagram of another embodiment of a compensating rope sheave and tie down assembly.

Another embodiment of the present invention is shown in FIG. 2, wherein a stronger apparatus is provided to support a heavier load. The system 10 comprises the conventional inertia reel 18 with the spring retraction mechanism 19 wherefrom the strap 22 extends. The system 10 further comprises a plurality of ratchets 30 fixedly attached to the pit floor 20, a plurality of stops 32, and a plurality of pawls 34 with a spring 36 disposed therebetween. A metal plate 38 extends from the compensating rope sheave housing 16 to support the pawls 34 which are fixedly attached thereto at a pivot point 40. The pawls 34 are further restrained by the spring 36 to maintain an obtuse angle facing upward. The strap 22 is forked into two branches 44,45 with each branch attached to the middle of each pawl 34. The set of stops 32 is disposed below the pawls 34 and attached to the metal plate 38.

Figure 3:
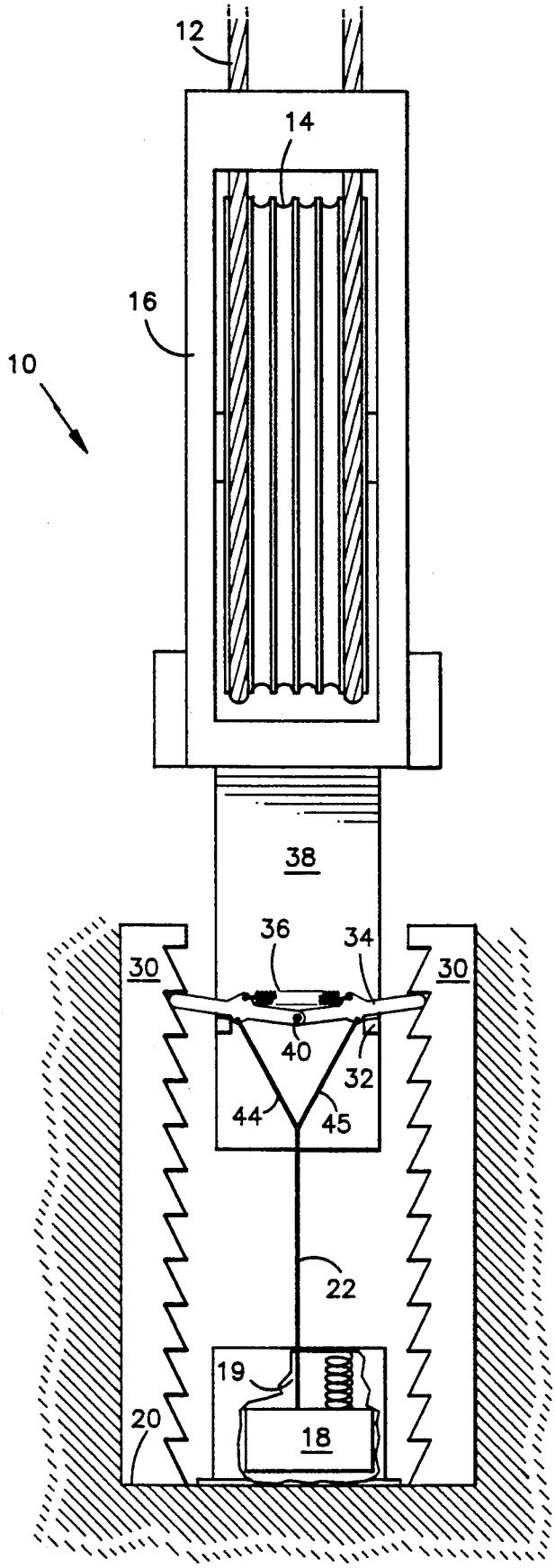
FIG. 3 is a diagram of another embodiment of a compensating rope sheave and tie down assembly of FIG. 2 showing pawls engaging the ratchet.

In normal operation, the inertia reel 18 allows the strap 22 to travel slowly with the sheave 16 to accommodate for expansion and contraction within the compensating rope 12. However, if the elevator car experiences a sudden upward movement the sheave will also tend to move upward. The sudden upward movement of the sheave, and subsequently, of the elevator car will be prevented by the compensating rope sheave tie down. As the sheave with the metal plate 38 is pulled up, the strap 22 is subjected to a sudden change in the rate of acceleration which facilitates the locking-up of the inertia reel 18. As one end of the strap 22 is locked by the inertia reel 18 and the sheave 14 is still being pulled upward, the strap branches 44,45 hold the pawls 34 down, thereby overcoming the spring 36 force. Thus, as the spring 36 yields to the downward force of the strap, the pawls 34 engage the ratchets 30, thereby locking the compensating rope sheave 14 from further upward movement, as shown in FIG. 3. This will also prevent the elevator car's upward movement, since the compensating rope 12 will not be able to travel upward quickly enough to allow the elevator car's further travel. The stops 32 prevent pawls 34 from rotating downward and escaping the ratchet engagement. Since the pawls 34 remain disengaged from the ratchets 30 until sudden upward movement of the compensating rope sheave 16 is experienced, the jam condition does not occur in this system as it would in a conventional ratchet and pawl system.

Although the invention has been shown and described with respect to a best mode embodiment thereof, it should be understood by those of ordinary skill in the art that the foregoing and various other changes, omissions and additions in the form and detail thereof may be made herein without departing from the spirit and scope of the invention.

We claim:

1. A tie down mechanism for a compensating rope sheave dispensing a compensating rope for use in an elevator system, comprising:

a fastening means for attaching said tie down mechanism to said compensating rope sheave;

a strap means having a first and a second end, said first end attached to said fastening means;

a retaining means for preventing sudden accelerated motion of said strap upon sensing an accelerated rate of extension of said strap, said retaining means dispensing said second end of said strap means; and a retraction means for maintaining said strap taut.

2. The tie down mechanism of claim 1, wherein said retaining means comprises an inertia reel.

3. The tie down mechanism of claim 2, wherein said retraction means for maintaining said strap taut comprises a spring retraction mechanism.

4. The tie down mechanism of claim 2, wherein said fastening means comprises a fastener that secures said first end of said strap onto said compensating rope sheave.

5. The tie down mechanism of claim 2, wherein said fastening means comprises a plate having two ends, said one end of said plate fixedly attached to said sheave.

6. The tie down mechanism of claim 5, wherein said first end of said strap means further comprises two branches thereof.

7. The tie down mechanism of claim 6, further comprising:

a plurality of pawls attached to each other on one end thereof to form a pivot point, said each pawl attaches to said each branch of said strap means, said pivot point attaches to said plate;

a spring means for retaining said plurality of pawls at an obtuse angle facing upward, said spring means attaching to said plurality of pawls;

a plurality of stops for preventing said plurality of pawls from being pulled downward by said strap, said plurality of stops is attached to said plate and disposed below said plurality of pawls; and a ratchet means disposed on both sides of said plurality of pawls, such that if said elevator car suddenly moves upward, said pawls engage said ratchets, thereby preventing said sheave and said elevator car from further upward movement.

8. The tie down mechanism of claim 7, wherein said retaining means comprises an inertia reel.

9. The tie down mechanism of claim 7, wherein said retraction means for maintaining said strap taut comprises a spring retraction mechanism.

* * * * *